US008726779B2

(12) United States Patent
Buhl et al.

(10) Patent No.: US 8,726,779 B2
(45) Date of Patent: May 20, 2014

(54) BREECHBLOCK DRIVE FOR A WEAPON

(75) Inventors: Rainer Buhl, Dornhan-Weiden (DE); Hubert Schneider, Dietingen (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 13/486,554

(22) Filed: Jun. 1, 2012

(65) Prior Publication Data

US 2012/0318127 A1 Dec. 20, 2012

Related U.S. Application Data

(63) Continuation of application No. PCT/EP2010/006751, filed on Nov. 5, 2010.

(30) Foreign Application Priority Data

Dec. 4, 2009 (DE) ..... 10 2009 056 735

(51) Int. Cl.
*F41F 1/10* (2006.01)

(52) U.S. Cl.
USPC ..... 89/33.01; 89/9; 89/11

(58) Field of Classification Search
USPC ..... 89/9, 11, 185, 33.01
See application file for complete search history.

(56) References Cited

U.S. PATENT DOCUMENTS

| | | | | |
|---|---|---|---|---|
| 430,206 | A | 6/1890 | Garland | |
| 3,302,523 | A * | 2/1967 | Adams et al. | 89/7 |
| 4,301,709 | A | 11/1981 | Bohorquez et al. | |
| 4,418,607 | A | 12/1983 | Price | |
| 4,481,858 | A | 11/1984 | Price | |
| 4,563,936 | A | 1/1986 | Cleary et al. | |
| 4,665,793 | A | 5/1987 | Cleary et al. | |
| 8,297,167 | B2 * | 10/2012 | Hoffman | 89/11 |

FOREIGN PATENT DOCUMENTS

| | | |
|---|---|---|
| DE | 30 21 200 | 12/1980 |
| DE | 10 2007 048 468 | 4/2009 |
| DE | 10 2007 054 470 A | 5/2009 |
| EP | 1 767 891 A1 | 3/2007 |
| JP | 6-159991 | 6/1994 |
| WO | WO2010/063357 A1 | 6/2010 |

* cited by examiner

*Primary Examiner* — Daniel J Troy

(74) *Attorney, Agent, or Firm* — Muncy, Geissler, Olds & Lowe, P.C.

(57) ABSTRACT

A breech ammunition drive for the breech of a weapon using an external drive is provided. A long connecting rod converts the rotational movement into a linear breech movement, and a short connecting rod moves the breech. The rear end or pin of the long connecting rod is fixed on or in the drive, and the front end engages onto a rack that is fixed to the weapon and onto a slider of the breech support or the breech via a toothing. The short connecting rod is retained in the slider and guided by same, and the connecting rod engages into a transverse slot introduced above the connecting rod and below the breech support. The short connecting rod is guided in the slot fixed to the weapon, the slot having a rear end point into which the connecting rod is inserted.

13 Claims, 3 Drawing Sheets

BREECHBLOCK DRIVE FOR A WEAPON

This nonprovisional application is a continuation of International Application No. PCT/EP2010/006751, which was filed on Nov. 5, 2010, and which claims priority to German Patent Application No. DE 10 2009 056 735.6, which was filed in Germany on Dec. 4, 2009, and which are both herein incorporated by reference.

BACKGROUND OF THE INVENTION

1. Field of the Invention

The invention relates to a breechblock drive for linear feeding of a round of ammunition/cartridge into a chamber of a gun barrel, wherein the breechblock is preferably locked from behind so as to produce a weapon that is small in size.

2. Description of the Background Art

It is known for a cartridge to be placed in front of a breechblock and for the cartridge to be brought into the gun barrel with the aid of the breechblock motion. The breechblock motion here is based on dwell times during which the breechblock cannot be allowed to move.

The externally driven autocannon known under the name Bushmaster has a circulating chain as the function control and drive for moving the breechblock and ammunition feed, which also gives it the name "chain gun." Required dwell times are implemented by the guidance of the chain (U.S. Pat. No. 4,418,607; U.S. Pat. No. 4,481,858; U.S. Pat. No. 4,563,936; U.S. Pat. No. 4,665,793; DE 30 21 200 C, which corresponds to U.S. Pat. No. 4,301,709).

DE 10 2007 048 468 A describes a drive for linear feeding of ammunition to a gun barrel or chamber by means of a chain. The chain itself is guided closely around two sprockets in a simple manner. A chain link or a cam of the chain is engaged in a guide or channel located below the movable slider. By this means, the chain can continue to move during dwell periods of the weapon that are defined by the function control. The chain itself can be driven by an electric motor.

In contrast, for linear feeding of a breechblock to the gun barrel or chamber, DE 10 2007 054 470 A proposes incorporating a straight guide channel into the drive kinematics. A means that is structurally connected to the breechblock is guided in the guide channel. The guide channel in turn is surrounded by a circulating guide (gate), which in its turn interprets the required dwell times of the breechblock during locking, firing, and unlocking in its forward position, and during reloading after the breechblock has been guided to its rear position. An additional means is guided in the guide as the drive means for the breechblock. The transmission of the drive can be implemented by means of rollers, gears, or the like, which are driven by a motor, etc. The drive itself continues to run during the dwell periods of the weapon.

SUMMARY OF THE INVENTION

It is therefore an object of the invention to provide a compact weapon with simple construction for guiding and moving a breechblock.

The invention is based on the idea of integrating what is known as a rear-locking breechblock and producing the dwell times required for breechblock guidance (feeding) by means of slots between which a (control) slider is engaged, said slider in turn being functionally connected to the breechblock support (or directly to the breechblock). This involves what is known as a slot fixed with respect to the weapon for the breechblock guidance and a locking slot for locking the breechblock.

A breechblock that can be locked from behind has the advantage that the feed travel for the ammunition into the chamber can be reduced because the breechblock is rotated behind the chamber entrance. The locking lugs are located behind the chamber entrance in this case.

The slot fixed with respect to the weapon, which preferably is integrated below the breechblock, serves to feed the breechblock, and works together with a first, longer connecting rod of a cam disk of the breechblock drive. By means of the longer connecting rod, the breechblock support, and thus the breechblock, are moved in the firing direction and opposite thereto via a stationary part on the weapon. The rotary motion of the cam disk is converted into a linear motion by means of a rack.

To this end, the connecting rod is fastened to/integrated into the slot at its back end or pin. The connecting rod engages at its front end (viewed in the direction of firing) via toothing with the rack fixed with respect to the weapon and the slider of the breechblock support. In this design, a better transmission ratio for the breechblock motion can be established. An additional, shorter connecting rod is incorporated into the slider; this connecting rod engages the slider, and also has means by which a functional connection is produced between the slot fixed with respect to the weapon and the breechblock support or the breechblock. In a preferred embodiment, this involves two rollers, wherein the lower roller engages the slot fixed with respect to the weapon and the upper roller engages a transverse channel in the breechblock support.

The zero position (breechblock dwell) is integrated into the rear endpoint of the slot fixed with respect to the weapon; the dwell time of the breechblock during the firing position is defined in the locking slot, which is integrated circumferentially into the breechblock support.

The feeding of the ammunition in front of the breechblock, which is to say while the breechblock has assumed its zero position, can be done in a variety of ways. It is only necessary to achieve the result that the feeding star for its part executes a motion and places a new round of ammunition in front of the breechblock and also places the empty cartridge casing back in the belt element.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
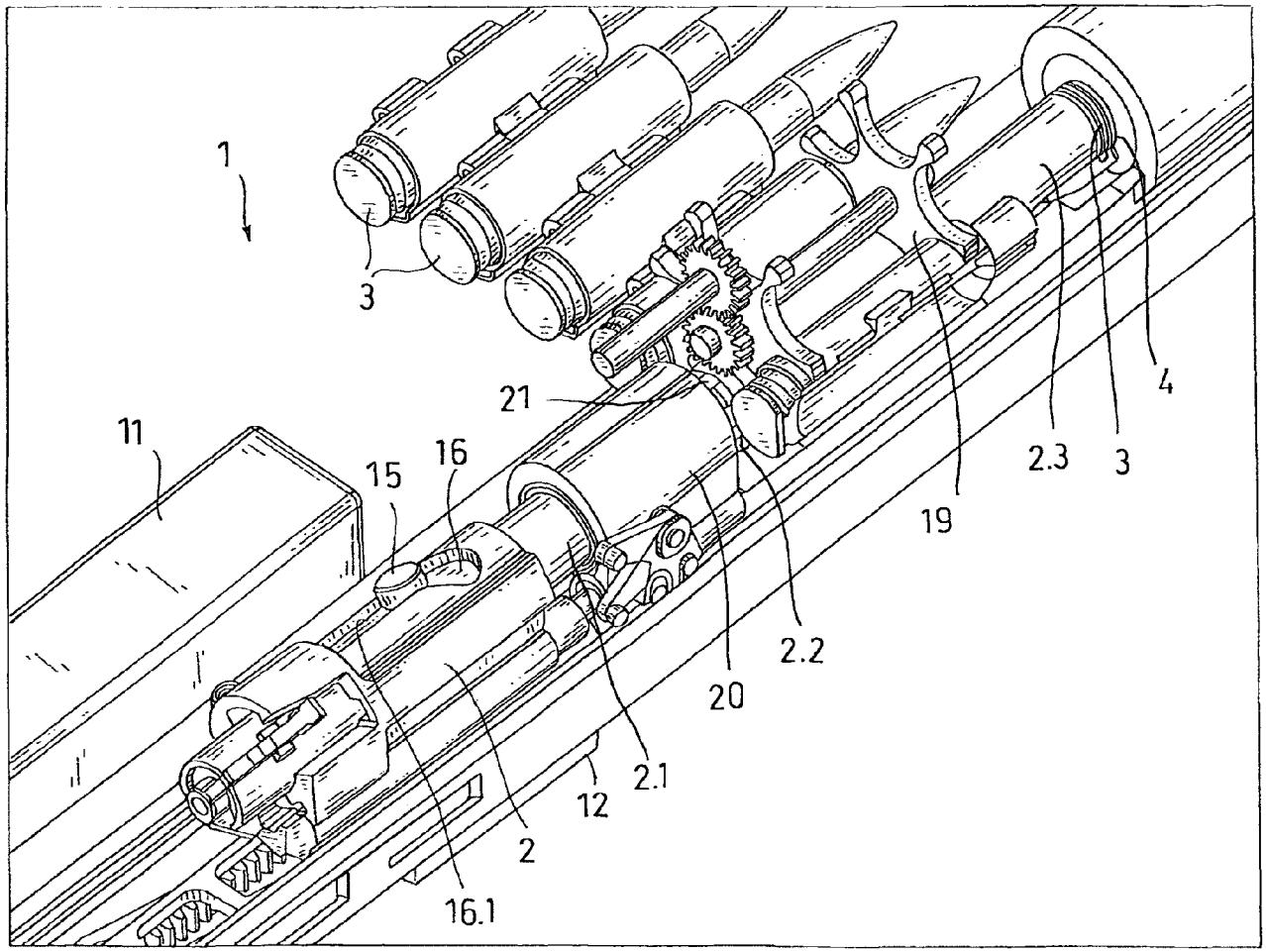
FIG. 1 is a perspective view of a weapon, partially without housing, in the locked position.

In the figures, 1 identifies a weapon that is characterized by straight feeding of a breechblock 2.1 or breechblock support 2 to feed a round of ammunition 3 into a chamber 4 of a weapon barrel of the weapon 1. Preferably, the feeding of the round of ammunition 3 is accomplished by a feeding star 19, and the feeding of the breechblock 2.1 or breechblock support 2 is accomplished by means of gates and guides, integrated into the weapon system, that are required for the feed and dwell times in the system. The breechblock 2.1 in this exemplary embodiment is characterized in that it can be locked from behind.

FIG. 1 shows the weapon system or weapon 1 in the locked condition. Here, the breechblock 2.1 is locked (locking lugs 21) in or to a part 20 that is stationary (on the weapon housing). The breechblock 2.1 is composed of a rear locking region 2.2 and a breechblock chamber 2.3. The end face of the breechblock chamber 2.3 is made such that it can engage in the groove in the cartridge base 4.1 of the cartridge or round of ammunition 3, and can carry it forward into the chamber 4 and can carry it out of the chamber 4 again after firing and deposit it in the feeding star 19. Obturation to the chamber 4 of the gun barrel 1 itself is accomplished by means of the casing of the round of ammunition 3 itself. The firing pin (not shown in detail) required for ignition of the round of ammunition 3 is guided and held inside the breechblock chamber 2.3.

Figure 2:
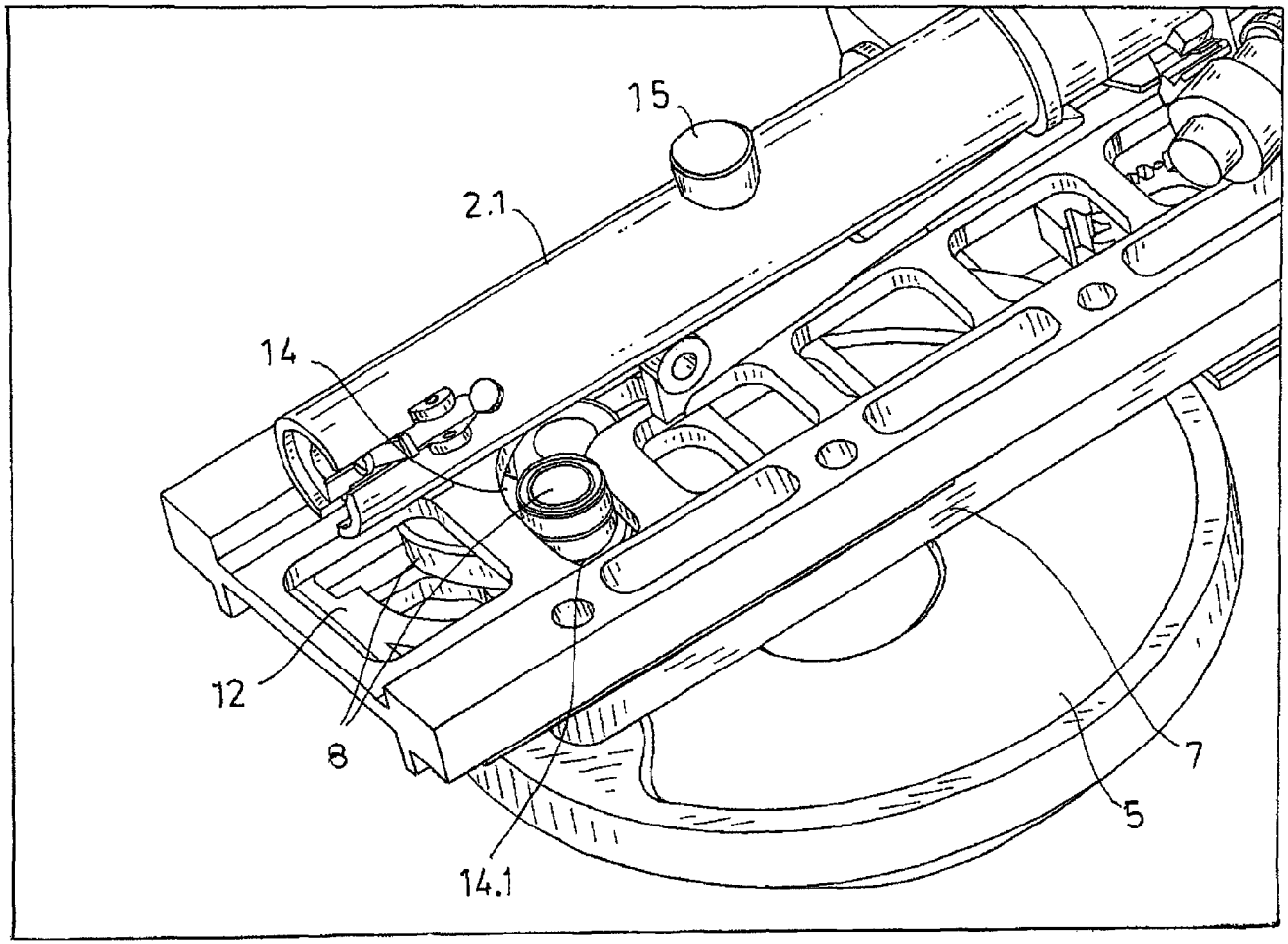
FIG. 2 is a view of the rear part of the breechblock drive from FIG. 1 without breechblock support.
Figure 3:
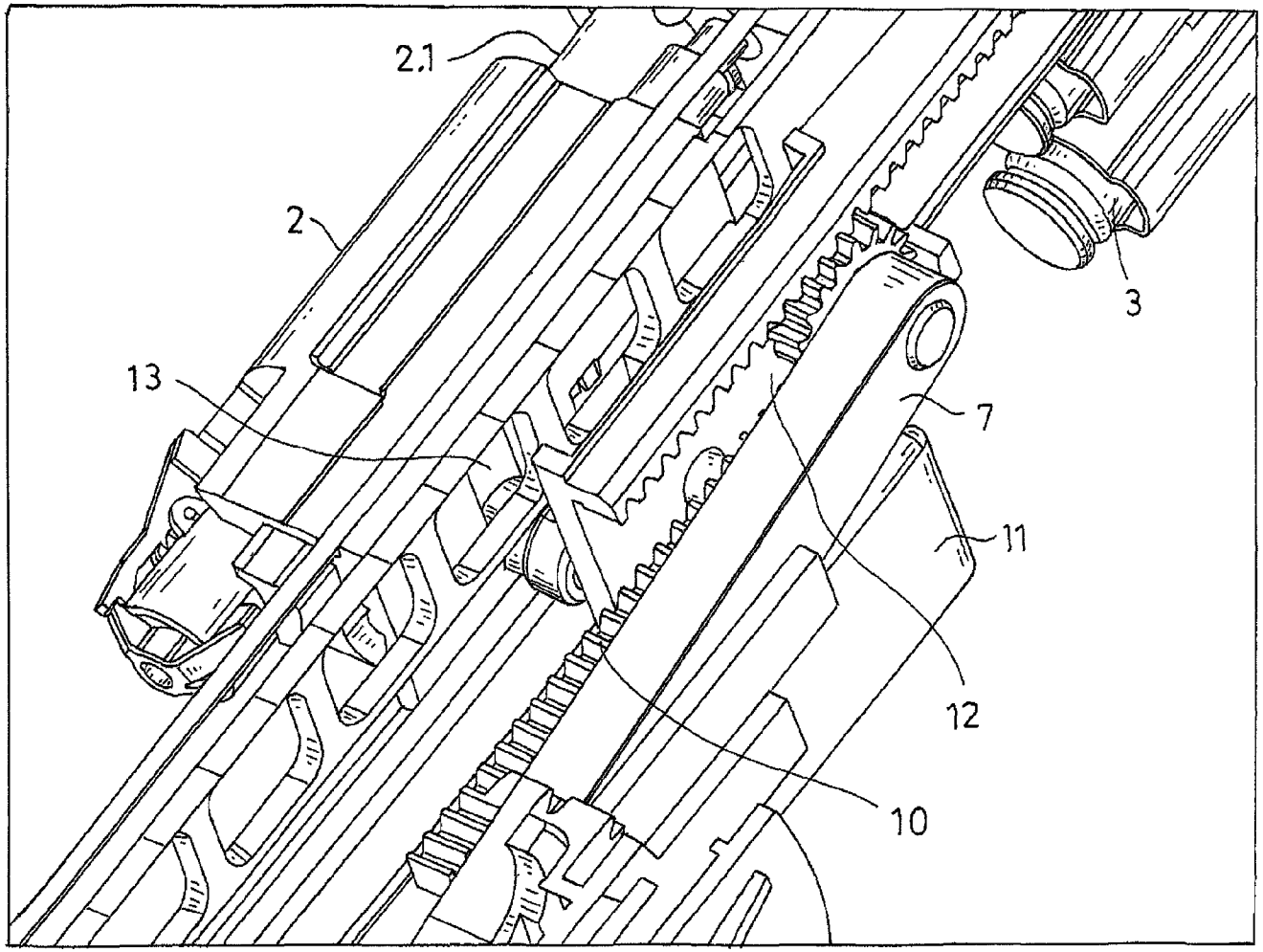
FIG. 3 is an enlarged view of the breechblock drive in a perspective view from below.

FIG. 2 shows a top view of a drive disk 5 for the breechblock drive, in which a long connecting rod 7 (FIG. 3) is integrated and to which the connecting rod is functionally connected. The short connecting rod 8 is held at one end in the slider 12 and guided therewith. At the other end, the short connecting rod 8 engages in a transverse slot 13 introduced above the connecting rod 8 and below the breechblock support 2 (FIG. 2). The short connecting rod 8 is guided in a slot 14 that is fixed with respect to the weapon, and carries the breechblock support 2 backward or forward on account of the engagement with the transverse slot 13 when the slider 12 is displaced by the long connecting rod 7.

In the rear end position, the so-called dead center point of the feed, the connecting rod 8 is pivotable. This makes it possible for the breechblock support 2 to remain stationary (dwell time) in this rear position as the round of ammunition 3 is fed, while the system or the slider 12 continues to travel a short distance further. In this end position, the slot 14 has an endpoint 14.1 into which the connecting rod 8 is pushed as it leaves the transverse slot 13. As a result of the pivotability, the slider 12 can continue to travel below the end point 14.1 in the slot 14 in spite of said end point. This design implements the—rear—dwell time of the breechblock during which ammunition loading takes place, since the connecting rod 8 can escape into the transverse slot 13 for the rear dwell of the breechblock 2.1.

The long connecting rod 7 serves to convert the rotary motion of the disk 5 into a linear breechblock motion, and thus to actually move the breechblock/breechblock support 2, in conjunction with a short connecting rod 8. The rear end or pin of the long connecting rod 7 is fastened to/integrated into the cam disk 5. The front end (viewed in the direction of firing) of the connecting rod 7 engages via toothing 9 (FIG. 3) with a rack 10 fixed with respect to the weapon and with the slider 12 of the breechblock support 2. In this way, a better transmission ratio (for example, 1:2) can be established for the breechblock motion itself. This has the advantage that the diameter of the crankcase (disk 5) can be made smaller by one half than in the case of a 1:1 transmission. This entails lower weight.

The breechblock support 2 and breechblock 2.1 are structurally connected to one another by a carrier 15 that is functionally attached in a fixed manner to the breechblock 2.1. The locking of the breechblock is achieved by means of an additional locking slot 16 (channel) integrated into the breechblock support 2, into which the carrier 15 can escape for locking.

A linear motion is imposed on the long connecting rod 7 by the rotation of the disk 5. In this way, the toothing 9 is moved, in turn displacing the slider 12 along the rack 10 that is fixed with respect to the weapon.

For its part, the slider 12 moves the breechblock 2.1 from the front position—firing position—to a rear position—loading position—and back through the stationary part 20 via the breechblock support 2. In the rear position, the round of ammunition 3 is placed in the feeding star, and is then carried along with the forward motion of the breechblock 2.1 (by the breechblock chamber 2.3) into the chamber 4.

Once the breechblock 2.1 reaches its front stop position, the slider 12 moves slightly further into its front end position, and the breechblock support 2 moves further via the top slot 16 into a locked position, which is preferably integrated above the breechblock support 2, in order to lock the breechblock 2.1. For locking, the locking lugs 21 engage in/on corresponding receptacles of the part 20, and the cam 15 moves out of the slot 16 into a locking path 16.1 of the locking slot 16. In this way, a floating support (accommodating reverse motion) of the breechblock 2.1 is achieved in the firing position.

The drive 5 or the disk can have external toothing (not shown in detail), for example, in order to allow it to be rotated via a gear or gear combination driven by an external drive. However, alternatives are possible as well, such as direct drive of the disk 5, for example.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A breechblock feed for a breechblock of a weapon, comprising:

the breechblock;

a breechblock support of the breechblock;

a drive; and a long connecting rod and a short connecting rod, the long connecting rod and the short connecting rod being functionally connected to the drive, the long connecting rod having a back end fastened to the drive and a front end connected to a rack via toothing, the rack being fixed with respect to the weapon, and the long connecting rod front end being connected to a slider of the breechblock, the short connecting rod being mounted on the slider and engaging a transverse slot located in a structure fixed with respect to the weapon and above the long connecting rod and below the breechblock support.

2. The breechblock feed according to claim 1, wherein the short connecting rod is guided in the transverse slot the transverse slot having a rear end point into which the short connecting rod is pushed.

3. The breechblock feed according to claim 2, wherein the short connecting rod is pivotable in the rear end position in the end point of the transverse slot.

4. The breechblock feed according to claim 1, wherein the breechblock support and the breechblock are structurally connected to one another by a carrier that is functionally attached in a fixed manner to the breechblock.

5. The breechblock feed according to claim 4, further comprising a locking slot integrated into the breechblock support, into which the carrier is adapted to shift to lock the breechblock.

6. The breechblock feed according to claim 5, wherein the locking slot has a curved locking path configured to guide the carrier to rotate the breechblock about a longitudinal axis.

7. The breechblock feed according to claim 1, wherein the drive is a disk.

8. The breechblock feed according to claim 7, wherein the long connecting rod serves to convert the rotary motion into a linear breechblock motion, and the short connecting rod serves to move the breechblock or the breechblock support.

9. A weapon comprising:

a breechblock feed according to claim 1; and a rear-locking breechblock.

10. The breechblock feed according to claim 1, wherein the breechblock feed is a rear-locking breechblock.

11. A breechblock feed for a breechblock of a weapon, comprising a drive;

a long connecting rod having a first end connected to the drive and a second end having a toothed wheel, the toothed wheel being mounted between a first rack fixed relative to the weapon and a second rack on a slider; and a short connecting rod having a first end pivotably mounted on the slider and a second end engaging a slot fixed relative to the weapon, wherein the slider supports a breechblock, and wherein the slider and breechblock are mounted such that the slider is capable of moving independently of the breechblock when the second end of the short connecting rod is outside the slot fixed relative to the weapon.

12. The breechblock feed according to claim 11, including a cam surface for shifting the second end of the short connecting rod out of the slot fixed relative to the weapon.

13. The breechblock feed according to claim 12, wherein the breechblock is slideably mounted in the breechblock support, wherein the breechblock includes a carrier slidably received in a guide slot of the breech block support, and wherein the guide slot includes a curved portion for rotating the breechblock about a longitudinal axis as the carrier moves along the curved portion.

* * * * *